United States Patent [19]

Richards

[11] 4,232,250

[45] Nov. 4, 1980

[54] NO-FLASH ERASE OF DIRECT VIEWING BISTABLE STORAGE CRT

[75] Inventor: Mark A. Richards, Pasadena, Calif.

[73] Assignee: Tektronix, Inc., Beaverton, Oreg.

[21] Appl. No.: 31,676

[22] Filed: Apr. 19, 1979

[51] Int. Cl.[3] ..... H01J 29/50; H01J 31/00

[52] U.S. Cl. ..... 315/13 ST; 328/123

[58] Field of Search ..... 315/13 ST; 328/123, 328/124; 340/797

[56] References Cited

U.S. PATENT DOCUMENTS

| | | | |
|---|---|---|---|
| 3,293,473 | 12/1966 | Anderson . | |
| 3,413,513 | 12/1968 | Donoghue et al. | 315/13 ST |
| 3,594,607 | 7/1971 | Frankland . | |
| 3,611,000 | 10/1971 | Johnston . | |
| 3,970,889 | 7/1976 | Cobb . | |

OTHER PUBLICATIONS

Devere, *Storage Cathode-Ray Tubes and Circuits*, 2nd Ed., 1971, Tektronix Circuit Concepts Series, pp. 19, 20, 47-52.

Schmid, *Principles of Storage Tubes and Oscilloscopes*, 3rd Ed., 1977, Tektronix, U.K. Ltd., pp. 17, 18.

*Primary Examiner*—Theodore M. Blum

*Attorney, Agent, or Firm*—John D. Winkelman

[57] ABSTRACT

An improved erase cycle for direct-viewing bistable storage tubes that substantially eliminates the bright flash characteristic of conventional erasure methods. As applied to the backplate of a meshless storage tube, the improved cycle suitably comprises two or more short (about 2 to 10 ms) fade positive pulses separated by a negative, decaying recovery pulse about 50-100 ms in length and optionally, a "dead time" of about 200 ms at the target operating level. The final fade positive pulse is followed by a longer recovery interval that gradually increases the backplate voltage to its previous operating level while the flood guns retain the storage phosphor in an erased, unwritten condition.

9 Claims, 6 Drawing Figures

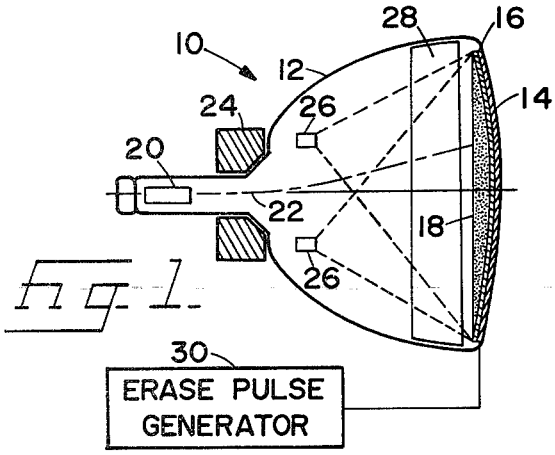
Fig. 1.
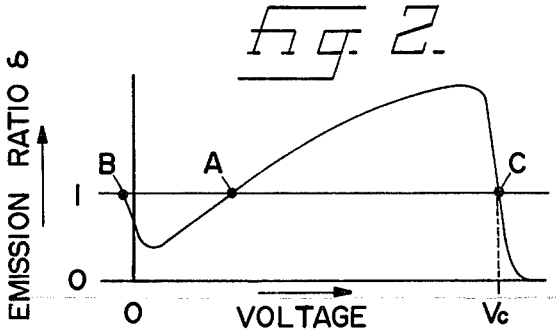
Fig. 2.
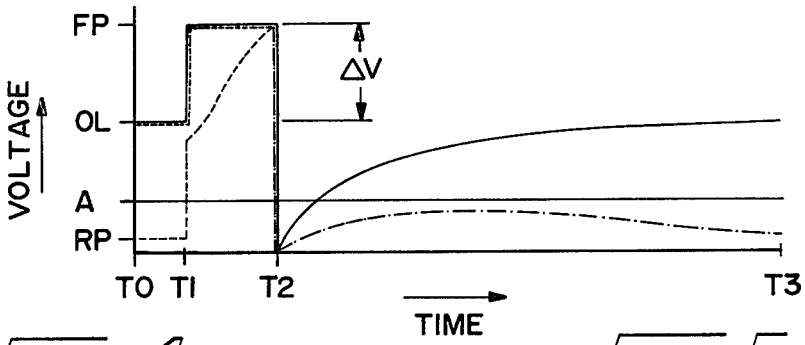
Fig. 3 (PRIOR ART)
Fig. 4.
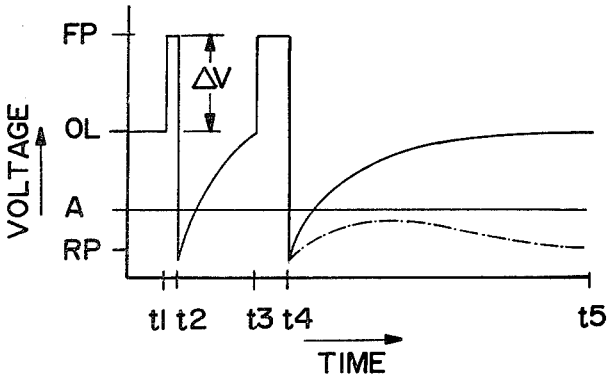
Fig. 5.
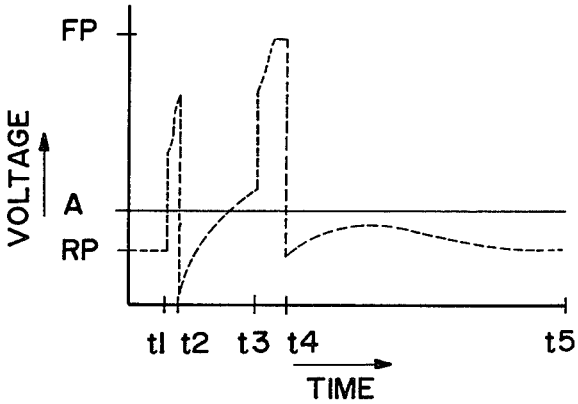
Fig. 6.
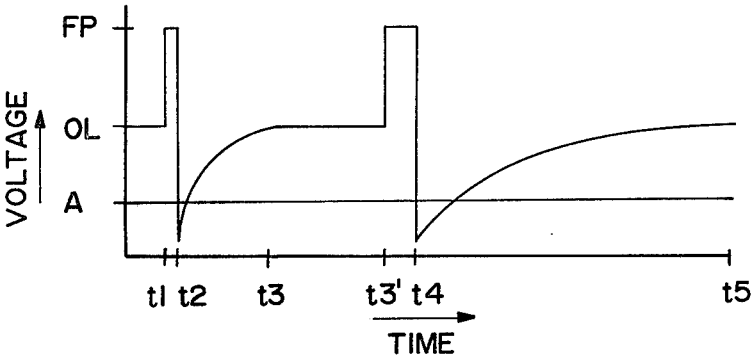

NO-FLASH ERASE OF DIRECT VIEWING BISTABLE STORAGE CRT

BACKGROUND AND OBJECTS OF THE INVENTION

The present invention relates generally to direct-viewing bistable storage tubes, and more particularly to an improved method for erasing images stored by such tubes.

Direct-viewing bistable storage tubes, which will also be referred to below as DVST's or simply "storage tubes," have achieved significant commerical success as information display devices for computers. One of the principal advantages of DVST's in this application is their ability to store and display information indefinitely. This eliminates the need for periodic display refreshment by the computer or by dedicated refresh circuitry provided within the display unit.

User demands for greater display capacity have led to the development of larger and larger size storage tubes. Over the past 15 years, for example, commercially available DVST's have increased in display screen area from a maximum of 80 $cm^2$ in 1962 to 1770 $cm^2$ today. The larger size display screens have seriously aggravated an already annoying characteristic of conventional storage tube operation—a bright flash that occurs when the entire display screen is momentarily brightly illuminated during the image erase cycle. The flash from a 19 in. or 25 in. storage tube is very hard on a viewer's eyes, particularly when the display unit is used in a darkened room.

Accordingly, a general object of the present invention is to provide an improved method of erasing information stored by a direct-viewing bistable storage tube.

A more specific object of the invention is to provide an improved method of operating a DVST to minimize or eliminate the bright flash that accompanies the standard erase cycle.

Another object of the invention is to provide an improved DVST erase cycle that minimizes or eliminates the usual bright flash without adversely affecting the storage tube's operating or image display characteristics.

Still another object of the invention is to provide an improved DVST erase cycle of reduced overall length.

A further object is to provide an improved DVST erase method that minimizes the production of dark residual images.

SUMMARY OF THE INVENTION

In accordance with a preferred embodiment of the present invention, images are erased from the storage/-display screen of a direct-viewing bistable storage CRT by means of an erase cycle comprising a plurality of short duration (e.g., less than about ten milliseconds) voltage pulses, each of which raise unwritten, or non-image, areas of the screen above the first crossover point on the secondary electron emission curve for the storage screen.

BRIEF DESCRIPTION OF THE DRAWINGS

FIG. 1 is a simplified sectional view taken along the longitudinal midline of a direct-viewing bistable storage CRT, together with associated erase circuitry;

FIG. 2 graphically depicts the secondary electron emission curve of the bistable storage phosphor incorporated in the FIG. 1 CRT;

FIG. 3 illustrates waveforms characteristic of prior art erase cycles;

FIGS. 4 and 5 depict erase cycle waveforms according to one embodiment of the present invention; and FIG. 6 shows an erase cycle waveform in accordance with another embodiment of the invention.

DETAILED DESCRIPTION OF THE INVENTION

Referring first to FIG. 1, a typical direct-viewing bistable storage tube 10 includes an evacuated envelope 12 having a transparent faceplate 14 at one end. Supported by faceplate 14 is a storage target that includes a conductive target electrode, or backplate, 16 and a dielectric storage phosphor layer 18. The faceplate and storage target together may be referred to as a viewing screen. The storage target of DVST 10 suitably consists of a thin, porous layer 18 of a bistable storage phosphor —P1 for example—overlying a backplate 16 formed by a thin, transparent conductive film of tin oxide or other suitable material. Such a target is the subject of U.S. Pat. No. 3,293,473 to Robert H. Anderson. Other suitable "meshless" targets are disclosed in U.S. Pat. Nos. 3,293,474 to Gibson, Jr., 3,401,293 to Morris, 3,531,675 to Frankland, 3,614,820 to Morris, and 3,978,366 to Steele.

Mounted at the opposite end of the tube within the neck of envelope 12 is a writing gun 20 for forming a beam 22 of high velocity electrons directed toward the viewing screen. Beam 22 is moved across the surface of the storage target by signals applied to a deflection yoke 24 supported on the neck of the tube. One or more flood guns 26 mounted within envelope 12 forward (i.e., toward the viewing screen) of yoke 24 bombard the storage phosphor layer with low velocity electrons. A collimation system comprising one or more electrodes 28 on the inner surface of the CRT envelope optimizes the distribution of flood gun electrons over the surface of layer 18. Connected to backplate 16 is an erase pulse generator 30, the function of which will be described in greater detail below.

Referring now to FIG. 2 along with FIG. 1, the basic operation of a DVST is by now well known. Briefly, with suitable potentials applied to writing gun 20, flood guns 26, collimation electrode(s) 28, and backplate 16, a charge image pattern is first "written" on storage layer 18 by electron beam 22. If the potential of the charge image exceeds the critical first crossover point A on the secondary electron emission curve for the storage phosphor (FIG. 2), the image pattern may be stored by bombarding the storage layer with low velocity electrons from flood guns 26. When the flood gun electrons strike unwritten areas of the phosphor, they tend to maintain such areas near the potential of the flood gun cathodes, typically 0 volts, or ground. This is the stable negative potential level or lower stable point of the target, designated point B in FIG. 2. Flood electrons striking written areas charge them to a stable positive potential, designated point C, near the potential Vc of backplate 16. As will be understood, more flood electrons are attracted to the relatively positive written areas of the phosphor storage layer and strike those areas with much greater velocity. The result is that written areas of the layer fluoresce much more brightly than unwritten areas, producing a viewable display of the storage charge image pattern.

When it is desired to erase already-stored images and prepare phosphor layer 18 to store and display new information, an erase cycle is initiated in which a positive voltage pulse first is applied to backplate 16 by erase pulse generator 30. This so-called "fade positive" pulse lifts the unwritten areas of layer 18 above the first crossover point A on the secondary emission curve (FIG. 2) and causes the entire surface of the phosphor layer to become fully written by the flood guns. Next, the backplate potential is reduced to move the target potential below the first crossover point by capacitive coupling, causing the storage phosphor to charge to a potential near its lower stable point B. Finally, the backplate potential is returned to Vc slowly enough that the flood guns are able to maintain the phosphor layer below the first crossover point.

A more-or-less standard prior art erase cycle is illustrated in FIG. 3, in which the DVST backplate potential is shown as a solid line, the potential of written, or stored image, areas is shown as a dotted line, and the potential of unwritten, background areas is shown as a dashed line. A dot-dash line indicates portions of the cycle during which the potentials of both the written and unwritten areas are essentially identical. At time TO, before the erase cycle is initiated, the target backplate voltage Vc is at a predetermined operating level (OL), as are the stored image areas of the phosphor storage layer. Background—i.e. nonstored—areas of the target are at rest potential (RP), a few volts above flood gun cathode potential, or ground. To erase the target, a positive step pulse first is applied to the backplate at T1, raising its potential by an amount Δ V. In a typical DVST, for example, the backplate potential is stepped to a fade positive (FP) level about 150 volts about its 200 volt operating level. The backplate is maintained at the FP level for a preset time ranging from a minimum of about 13 ms to about 80 ms, during which the nonstored areas are charged by flood gun electrons to the FP backplate potential. At time T2, when the entire storage layer is in a fully written condition, the backplate potential is pulsed in a negative direction to a point near ground potential, after which it is allowed to return slowly to its normal operating level. This operation pulls the phosphor storage layer down from the FP level to a point below its first crossover point A, after which flood gun action prevents the layer from being carried above the first crossover point as the backplate potential returns to OL. By time T3, the end of the erase cycle, backplate potential has reached the predetermined operating level, and the entire storage layer is in an unwritten condition at average RP. The entire erase cycle, including a 13 to 80 ms for the positive pulse (T1 to T2), typically requires about 1.5 seconds. Although the backplate voltage recovers to OL in about 600 ms, additional time is required for stabilization of the backplate current and fields within the tube. The principle visual effect of the standard erase cycle is a bright flash as the entire target is momentarily raised to a high level of illumination by the FP pulse. The flash effect is increased by a "negative flash" that follows as the target is suddenly dropped to near ground potential.

The improved erase method of the invention differs principally from the just-described conventional method in that a plurality of very short fade positive pulses are used instead of a single longer one. It has been determined that the bright flash effect of the fade positive pulse is significantly reduced at pulse times below about 10 ms, substantially reduced at about 5 ms, and is eliminated almost entirely at 2 ms. Although the storage screen can charge quickly enough to raise unwritten areas to the fade positive level within 2 ms or less, a single, short FP pulse results in the creation of "dark residuals". This causes previously written areas to appear slightly darker than the background luminance of the phosphor layer, producing a negative image of the erased positive image. The mechanism responsible for dark residuals is not well understood; however, they are not desirable since they interfere visually with subsequent bright image displays. Surprisingly, it has been found that the use of multiple short fade positive pulses separated by a reduced length recovery time produces complete erasure without forming excessive dark residuals.

A reduced flash-effect erase cycle according to one embodiment of the invention is shown in FIGS. 4 and 5. Referring first to FIG. 4, in which the backplate potential is shown as a solid line, a first fade positive pulse is applied to the backplate during the time interval between t1 and t2. This pulse is essentially the same as its counterpart in the standard erase cycle except that its duration is much shorter, i.e., no longer than 10 ms and preferably less than about 5 ms. A negative-going recovery pulse of about 50 to 100 ms follows immediately after the first fade positive pulse during the interval between t2 and t3, then another short fade positive pulse is applied during time interval t3 and t4. The second FP pulse may be identical to the first in length, but in any event has a duration no longer than about 10 ms or less, preferably 5 ms or less. Following the second FP pulse is a final negative-going slow recovery pulse during the interval t4 to t5. Allowing sufficient time for the backplate currents and fields inside the CRT to recover, the total erase cycle is reduced to about one second, a 50% reduction.

During the two FP pulses and the intervening short recovery pulse, written areas of the phosphor screen follow the backplate potential. During the final, longer recovery period, they remain below the first crossover point (A) as in the standard erase cycle. Referring to FIG. 5, which illustrates the effect of the improved erase cycle or unwritten or background areas of the phosphor storage layer, such areas rise in potential toward the FP level during the first positive pulse, but may not reach it because of the short duration of the pulse. When the second FP pulse is applied following the first recovery pulse interval (t2–t3), both the background and the previously written areas of the phosphor rise in potential by the same amount (Δ V), with any portions of the background that are not then at the FP level reaching it during the t3–t4 interval. The final, longer recovery interval returns both the previously written and the background areas of the storage layer to rest potential, readying the target for the receipt and storage of new information.

Using the just-described erase cycle, the usual bright erase flash is substantially eliminated, being replaced by a dim flicker that is more the result of the "negative flash" than the FP pulse. A double flicker is noticeable if the two FP pulses are separated by an interval of about 75 to 100 ms, but can be eliminated by using a closer pulse spacing. Experiments with DVST's having a mixed P−1+$Y_2O_3$ phosphor composition have demonstrated that complete erasure may be achieved using first and second fade positive pulses of about 2 and 5 ms, respectively, separated by a negative-going recovery pulse of about 50 ms duration. The final recovery interval preferably is on the order of 600 ms or longer for optimum contrast ratio.

To obtain good erasure with a minimum of dark residuals, it has been found helpful in certain instances to provide a "dead time" interval between the first recovery interval and the second fade positive pulse. An erase cycle that incorporates a dead time interval is shown in FIG. 6. In this embodiment, a first FP pulse of about 2–5 ms duration is followed by a 50–100 ms recovery interval (t2–t3). Following this, a dead time (t3–t3') interval of about 200 ms at OL is allowed for the DVST to stabilize. Following the dead time, a second FP pulse (t3'–t4) about 2–5 ms is applied to the backplate. The final recovery period may be about 300 to 500 ms, the latter providing a lower background luminance level. Such as erase cycle produces significantly less dark residuals than the standard erase cycle.

According to the improved erase method of the invention, DVST change images can be erased completely in less total time and with a decrease in the production of dark residual images compared to standard, single FP pulse erase cycles. In addition, it is believed that the use of a multiple FP pulse erase cycle may improve storage tube life, since it has been observed in life tests that tubes which are erased more often exhibit significantly longer life. Perhaps the greatest benefit, however, is the elimination of the annoying bright flash that is characteristic of the prior art erase cycle.

Although two preferred embodiments of the invention have been described in accordance with the best mode presently contemplated for its practice, it will be understood that various changes and modifications are possible within the scope of the invention as claimed. For example, the improved erase pulse may be applied to either the storage target backplate or (in the opposite polarity) to the flood gun cathode(s) or both. Further, it is within the ambit of the invention to employ three or more fade positive pulses of short duration, separated by suitable recovery intervals as disclosed.

The improved erasure method of the invention is applicable to mesh-type DVST's as well as those of the meshless variety. In a mesh-type storage tube, charge images are stored on a mesh-supported storage target suspended behind a conventional phosphor viewing screen. A collector mesh provided behind the storage target serves to collect secondary electrons emitted by the latter's storage dielectric In such a tube, erase pulses are applied to the storage target's support mesh, leaving the collector undisturbed.

I claim as my invention:

1. The method of erasing a charge image stored by a dielectric material provided on a target electrode in a bistable storage tube, which image is being maintained in a stored condition by bombardment of the dielectric material with low velocity electrons from a source thereof, said method comprising the subsequential steps of:

(a) increasing the voltage differential between said electron source and target electrode from a normal operating level to a selected higher, fade positive level sufficiently rapidly to raise the potential of the non-image areas of the dielectric material above the first crossover point on the secondary emission curve for the material, (b) maintaining said voltage differential at said higher level for a first time period not longer than about ten milliseconds, (c) reducing said voltage differential to a selected lower level sufficiently rapidly to lower the potential of said dielectric material below said first crossover point, (d) increasing said voltage differential to a normal operating level over a second time period, (e) repeating steps (a), (b) and (c), and (f) increasing said voltage differential to a normal operating level at a rate sufficiently slow to permit the dielectric material to be maintained at a potential below its first crossover point by the bombardment of said low velocity electrons.

2. The method of claim 1, wherein said voltage differential is increased and reduced by changing the voltage applied to said target electrode.

3. The method of claim 1, wherein said voltage differential is increased and reduced by changing the voltage applied to said electron source.

4. The method of claim 1, wherein said voltage differential is increased and reduced by changing the voltages applied to said target electrode and to said electron source.

5. The method of erasing a stored charge image in a direct-viewing bistable storage tube that includes a storage element of dielectric material provided on a target electrode, and means including an electron source maintained at a reference potential for bombarding the storage dielectric with low velocity electrons, said method comprising the subsequenial steps of:

(a) rapidly increasing the potential of said target electrode relative to said reference potential from a normal operating level to a fade positive potential for the storage dielectric, (b) maintaining the electrode at said fade positive potential for a first period of time not greater than about ten milliseconds, (c) rapidly reducing the target electrode potential to a value below the first crossover potential for the storage dielectric, (d) increasing the target electrode potential to said operating level over a second period of time, (e) repeating steps (a), (b) and (c), and (f) increasing the target electrode potential to said operating level at a rate slow enough to permit said low velocity electrons to maintain the storage dielectric below said first crossover potential as the target potential is increased.

6. The method of claim 5 or 1, including the additional step intermediate steps (d) and (e) of maintaining the target electrode potential at said operating level for a third period of time.

7. The method of claim 5 or 1, wherein said first period of time is in the range of about two to five milliseconds.

8. The method of claim 5 or 1, wherein said second period of time is in the range of about 50 to 100 milliseconds.

9. The method of claim 6, wherein said third period of time is about 200 milliseconds.

* * * * *

UNITED STATES PATENT AND TRADEMARK OFFICE

CERTIFICATE OF CORRECTION

PATENT NO. : 4,232,250

DATED : November 4, 1980

INVENTOR(S) : Mark A. Richards

It is certified that error appears in the above-identified patent and that said Letters Patent are hereby corrected as shown below:

Col. 3, line 1, reads "storage charge" should be --stored charge--.

Col. 3, line 37, reads "about its 200" should be --above its 200--.

Signed and Sealed this

*Tenth* Day of *February 1981*

[SEAL]

*Attest:*

RENE D. TEGTMEYER

*Attesting Officer*

*Acting Commissioner of Patents and Trademarks*